US006779978B2

(12) United States Patent
Camargo Do Amarante

(10) Patent No.: US 6,779,978 B2
(45) Date of Patent: Aug. 24, 2004

(54) BLADE FOR AXIAL FLOW FAN

(75) Inventor: Odilon Antônio Camargo Do Amarante, Curitiba (BR)

(73) Assignee: Tecsis Technologia E Sistemas Avancados Ltda, Sorocaba SP (BR)

( * ) Notice: Subject to any disclaimer, the term of this patent is extended or adjusted under 35 U.S.C. 154(b) by 0 days.

(21) Appl. No.: 10/296,646

(22) PCT Filed: May 25, 2001

(86) PCT No.: PCT/BR01/00065

§ 371 (c)(1),
(2), (4) Date: Nov. 26, 2002

(87) PCT Pub. No.: WO01/92726

PCT Pub. Date: Dec. 6, 2001

(65) Prior Publication Data

US 2003/0165386 A1 Sep. 4, 2003

(30) Foreign Application Priority Data

May 30, 2000 (BR) ..... 0003706

(51) Int. Cl.[7] ..... F04D 29/38
(52) U.S. Cl. ..... 416/228
(58) Field of Search ..... 416/228, 238, 416/243

(56) References Cited

U.S. PATENT DOCUMENTS 1,638,129 A 8/1927 Parker
3,168,235 A * 2/1965 Valdi ..... 415/220
3,467,197 A * 9/1969 Spivey et al. ..... 416/228
4,012,172 A * 3/1977 Schwaar et al. ..... 416/228
4,089,618 A 5/1978 Patel
5,275,535 A 1/1994 Gongwer
5,326,225 A 7/1994 Joseph et al.
5,533,865 A * 7/1996 Dassen et al. ..... 416/228
5,603,607 A 2/1997 Kondo et al.
5,624,234 A 4/1997 Neely et al.

FOREIGN PATENT DOCUMENTS

| | | |
|---|---|---|
| DE | 617 039 | 8/1935 |
| EP | 0 955 469 | 11/1999 |
| WO | WO 95/13472 | 5/1995 |

* cited by examiner

*Primary Examiner*—Ninh H. Nguyen
(74) *Attorney, Agent, or Firm*—Collard & Roe, P.C.

(57) ABSTRACT

The present invention describes an axial flow fan blade that presents innovation on its shape that results in a lower noise emission and in a higher efficiency. The axial flow fan blade, object of the present patent, has a lower vortex emission than the blades available on the previous art. This lower vortex emission is responsible for a lower level of pressure fluctuations, which results in a lower noise emission, and is also responsible for a lower energy expense on the vortex formation, which results in an efficiency increase. The present axial flow fan blade can be employed in various applications where it is necessary to move any gas.

1 Claim, 3 Drawing Sheets

BLADE FOR AXIAL FLOW FAN

CROSS REFERENCE TO RELATED APPLICATIONS

Applicant claims priority under 35 U.S.C. §119 of Brazilian Application No. PI 0003706-0 filed May 30, 2000. Applicant also claims priority under 35 U.S.C. §365 of PCT/BR01/00065 filed May 25, 2001. The international application under PCT article 21(2) was published in English.

FIELD OF THE INVENTION

The present invention is related to a blade for axial flow fans which contains innovations on its shape in such a way that it produces a lower noise level and a higher efficiency than the fan blades available in the prior art.

BACKGROUND AND SUMMARY OF THE INVENTION

Axial flow fans have large application on many industry branches where it is necessary to move any gas, for example the air. Among the many components that constitute a fan, the blades are the elements that greatly influence its efficiency and noise level. The design of the other fan components that include, for example, the fixing structures and the fall body, demands a relatively small effort and it is well known in the prior art. Therefore, great attention should be given to the blade design in order to obtain a fan with the desired characteristics of noise level and efficiency.

There are many axial flow fan blades available in the prior art that contain some sort of improvement intended to reduce their noise level and to increase their efficiency. In U.S. Pat. No. 4,089,618 and No. 5,603,607, for example, fan blades with trailing edges containing notches or in a sawtooth shape are presented, and in U.S. Pat. No. 5,275,535 both the leading and the trailing edge are notched. Moreover, in U.S. Pat. No. 5,326,225 and No. 5,624,234 fan blades with planform shape curved forward and backward are presented. Furthermore, WO 95/13472 presents twisted fan blades with airfoil shaped sections.

Despite of the fact that these referred patents actually present a reduction on the noise level and an increase on the efficiency, the improvement obtained is quite modest. Furthermore, the inventive step present in these patents cannot be applied to all types of fan blade. Hence, the trailing edge with notches or in a sawtooth shape in U.S. Pat. No. 4,089,618 and No. 5,603,607, for example, only results in improvement in blades with very thin aerodynamic profile or in blades formed by a curved sheet. Consequently, the applicability of these patents is limited.

The noise produced by a fan blade comes from two main sources. The first source is the passage of the blade, during its rotational movement, over obstacles like the motor supports. Each time the blade passes over an obstacle it produces a pressure variation on the obstacle which results in noise emission, and the frequency of this noise is equal to the fan rotating frequency multiplied by the number of blades. This type of noise can be minimized by an adequate choice of the number of blades and by the design of the obstacles close to the blade rotation plane and, therefore, it will not be discussed in the present patent. The second noise source is the blade vortex emission. Vortexes are emitted at the blade trailing edge due to production of lift, as it is well known from the classical aerodynamics theory. Moreover, the vortex emission also occurs when there is flow separation over the blade. These emitted vortexes produce pressure variations which produce the noise. In opposition to the noise produced when the blades pass over obstacles, the noise produced by vortex emission does not present itself in only one frequency, but in a broadband related to the size of the emitted vortexes.

The present invention, then, presents technical innovation in the shape of a fan blade that results in a lower vortex emission and, therefore, in a reduction on the noise level produced by the fan. A lower vortex emission also implies in a lower amount of the energy provided to the fan being spent in the vortex production, such that a greater amount of energy can be used to produce work in the fluid. Hence, the reduction in the noise level comes with an increase in the fan efficiency.

BRIEF DESCRIPTION OF THE DRAWINGS

The accompanying drawings illustrate the low noise, high efficiency blade for axial flow fan, object of the present patent, in which.

DESCRIPTION OF PREFERRED EMBODIMENTS

Figure 1:
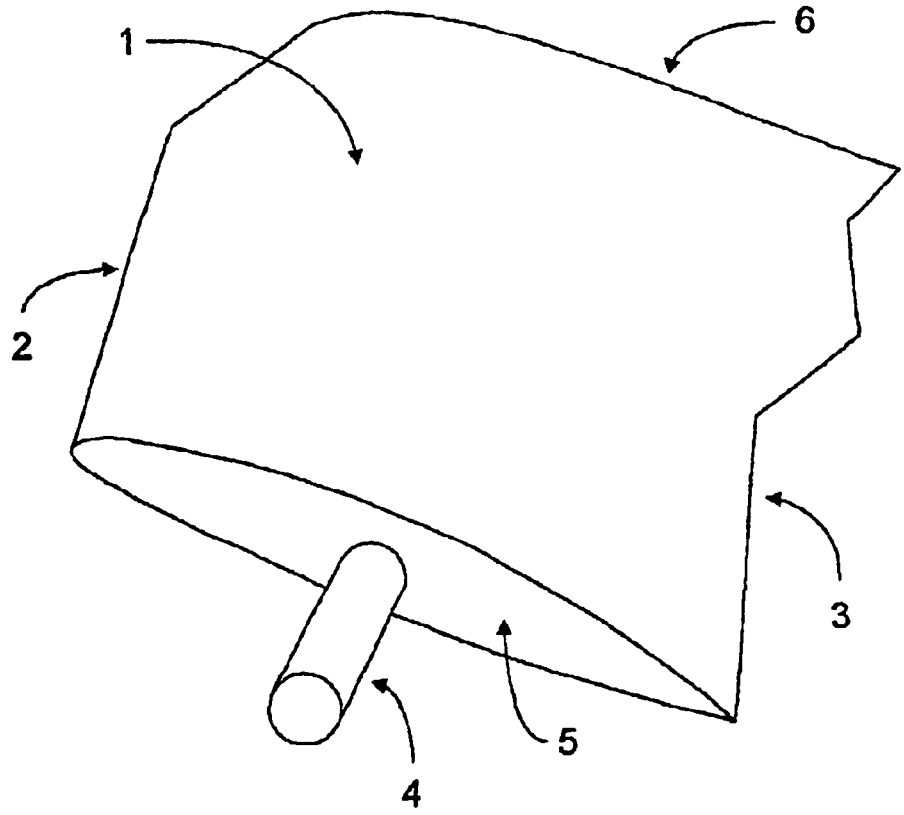
FIG. 1 shows a perspective view of the fan blade.

As shown in FIG. 1 the low noise, high efficiency blade for axial flow fan 1, object of the present patent, consists of an anterior extremity 2, named leading edge, a posterior extremity 3, named trailing edge, and a shank 4 to fasten blade 1 to the fan hub. The extremity of blade 1 closest to its rotation axis is named root 5, while the extremity farther from its rotation axis is named tip 6. The distance between the root 5 and the tip 6 of blade 1 is named span.

Figure 2:
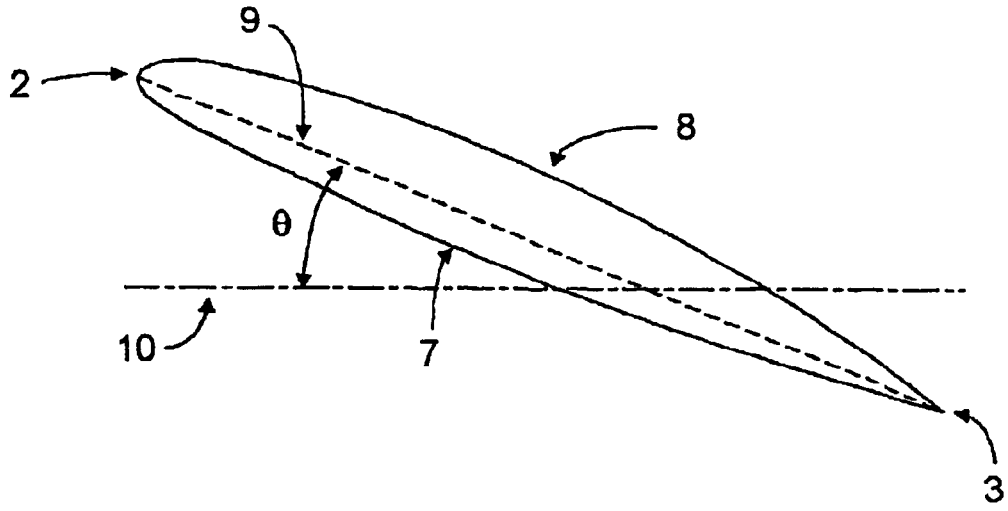
FIG. 2 shows a transversal section of the fan blade.

Each cross section of blade 1 has the shape of an aerodynamic profile, as illustrated in FIG. 2. The leading edge 2 and the trailing edge 3, according to the definition of FIG. 1, divide the aerodynamic profile in a lower side 7, named pressure side, and a upper side 8, named suction side. The imaginary line 9 that joins the leading edge 2 to the trailing edge 3 is named chord line, and its length is named chord. The angle between the chord line 9 and the rotation plan 10 of blade 1 is named twist angle θ.

Figure 3:
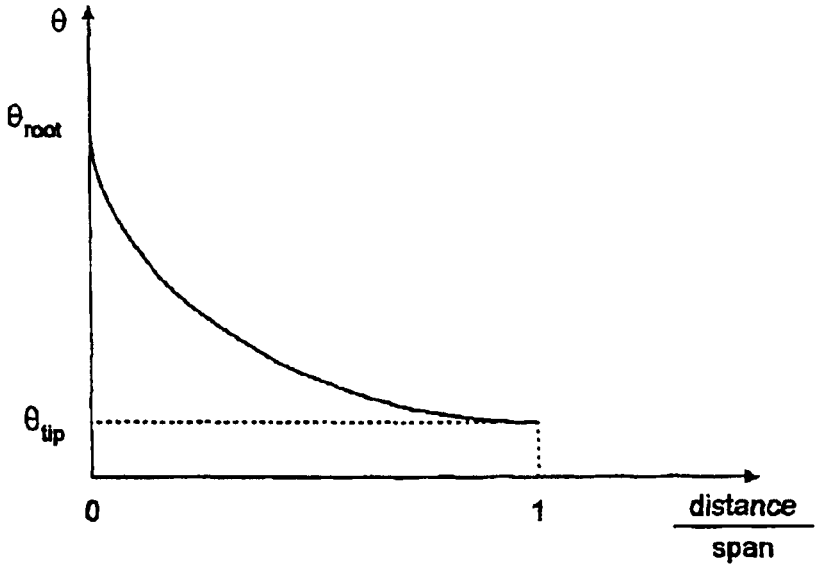
FIG. 3 shows a diagram of the blade twist distribution along the blade span.

Due to the rotational movement of the blade, the direction of the fluid that encounters the leading edge 2 is different for each section along the blade span. Therefore, in order to optimize the efficiency of blade 1, the twist angle θ varies along the blade span in such a way to compensate this difference in the direction of the fluid motion. The distribution of the twist angle along the span is illustrated in the graph in FIG. 3. The twist angle varies from a larger angle $\theta_{root}$ in the root 5 region to a smaller angle $\theta_{tip}$ in the tip 6 region of blade 1 .

Figure 4:
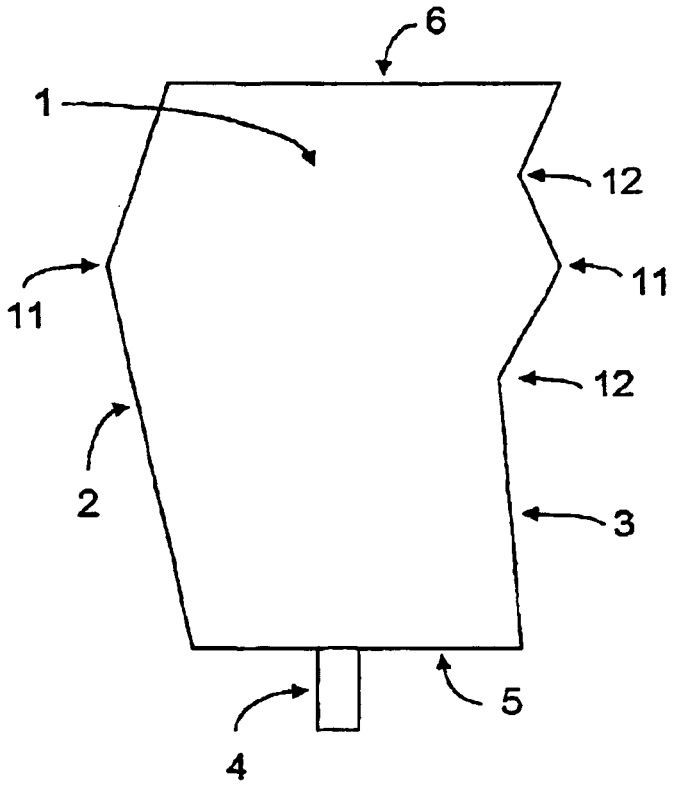
FIG. 4 shows the blade planform, that is, the projection of the blade shape over the rotation plan of the fan.

The feature of blade 1 that introduces a novelty over the previous art and that is responsible for the improvements in the noise level and in the efficiency, mentioned before, is the shape of the loading and trailing edges. As illustrated in FIG. 4, which shows the plan form of blade 1, that is, the projection of the blade shape over its rotation plan, the leading edge 2 and the trailing edge 3 are not rectilinear. The leading edge 2 and the trailing edge 3 are defined by line segments which form given angles between one and the other in such a way that protuberances 11 and re-entrances 12 are formed, as illustrated in FIG. 4.

The shape of the axial fan blade 1, as illustrated in FIG. 1, produces a disturbance in the fluid flow such that the velocity on the suction side 8 is higher than on the pressure side 7. Hence, the pressure on the suction side 8 is lower than the pressure on the pressure side 7, which results in the production of the lift force that is responsible for performing work over the fluid. This work performed over the fluid produces the pressure increase and the movement of the fluid, which are the basic functions of a fan.

Figure 5:
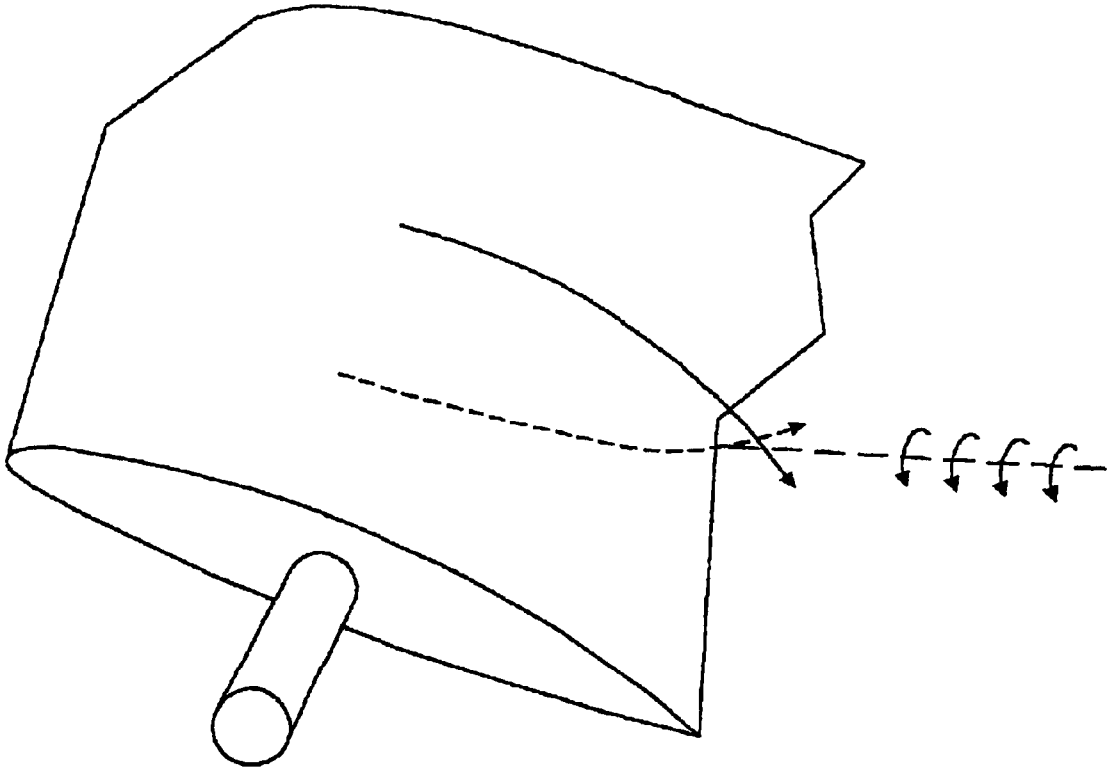
FIG. 5 shows a sketch of the blade vortex emission.

On the tip 6 of blade 1, the fluid that passes over the pressure side 7 joins with the fluid that passes over the suction side 8. Therefore, the pressure on the tip 6 has an intermediary value between the lower pressure of the suction side 8 and the higher pressure of the pressure side 7. Hence, as a fluid always has a tendency to move from a higher pressure region to a lower pressure region, on the suction side 8 of blade 1 the fluid tends to move on the direction from the tip 6 to the root 5, while on the pressure side 7 of blade 1 the fluid tends to move on the opposite direction, that is, on the direction from the root 5 to the tip 6. Thus, on the trailing edge 3 region, there is a discontinuity on the direction of the fluid that passes over the suction side 8 and the pressure side 7, resulting in the vortex emission on the trailing edge 3, as it is schematically shown in FIG. 5. Consequently, whenever there is a lift production on blade 1, that is, whenever there is a difference in the pressure between the suction side 8 and the pressure side 7, there will be vortex emission on the trailing edge 3.

The vortex emission occurs in any type of fan blade whenever it is producing lift. Hence, the noise emission and the loss of efficiency due to vortex emission are unavoidable in any type of fan blade. The technological innovation of the present patent is, therefore, on the shape of blade 1, which changes the lift distribution on the whole blade 1 and, consequently, minimizes the global vortex emission, resulting in a lower noise level and in a higher efficiency.

The blade for axial flow fan 1 can be constructed using various materials. The most indicated material is the fiber reinforced plastic due to its characteristics, which include low weight, high strength and easy conformation to complicated shapes such as that of blade 1. Other materials can also be used, such as metals, plastics or other types of composite materials.

An axial flow fan formed by a plurality of blades similar to blade 1 can be employed in various applications where it is necessary to move any gas. Among these applications there are fans for tunnels, for mining, for cooling towers, for air coolers, for the refrigeration of electric generators and for the refrigeration of motors.

Considering the large variety of possible applications of the axial flow fan blade 1, the figures presented in this report are not in scale, and they are only illustrative. Hence, the actual dimensions of the blade for a specific application must be determined from the requirements of this application. Moreover, also depending on the application, different aerodynamic profiles, twist distributions and number of protuberances 11 and re-entrances 12 may be used, following the main idea of this patent.

What is claimed is:

1. A blade for an axial flow fan to move any gas having a leading edge, a trailing edge, a pressure side and a suction side such that each transversal section of the blade has the shape of an aerodynamic profile, the twist angle $\theta$ of each section varies along the blade span from a larger angle $\theta_{root}$ in the root region of the blade to a smaller angle $\theta_{tip}$ in the tip region of the blade, wherein the leading edge and the trailing edge are defined by line segments which form given angles between one and the other in such a way that protuberances and re-entrances are formed in the leading edge and the trailing edge.

* * * * *